US011939780B2

(12) United States Patent
Muro Baglietto

(10) Patent No.: US 11,939,780 B2
(45) Date of Patent: Mar. 26, 2024

(54) JOINT FOR FLOOR COVERING PANELS AND COVERING ASSEMBLY COMPRISING SAID JOINT

(71) Applicant: BAGLINOX, S.L., Orcoyen (ES)

(72) Inventor: Julio Muro Baglietto, Orcoyen (ES)

(73) Assignee: BAGLINOX, S.L., Orcoyen (ES)

( * ) Notice: Subject to any disclaimer, the term of this patent is extended or adjusted under 35 U.S.C. 154(b) by 256 days.

(21) Appl. No.: 17/633,892

(22) PCT Filed: Aug. 9, 2019

(86) PCT No.: PCT/ES2019/070561
§ 371 (c)(1),
(2) Date: Feb. 8, 2022

(87) PCT Pub. No.: WO2021/028603
PCT Pub. Date: Feb. 18, 2021

(65) Prior Publication Data

US 2022/0325534 A1 Oct. 13, 2022

(51) Int. Cl.
*E04F 19/06* (2006.01)

(52) U.S. Cl.
CPC ..... *E04F 19/061* (2013.01); *E04F 19/062* (2013.01); *E04F 19/068* (2013.01)

(58) Field of Classification Search
CPC ..... E04F 19/061; E04F 19/062; E04F 19/068; E04F 19/063; E04F 19/066
See application file for complete search history.

(56) References Cited

U.S. PATENT DOCUMENTS

| | | | | |
|---|---|---|---|---|
| 4,858,405 | A * | 8/1989 | Christie | E06B 3/44 52/476 |
| 7,797,900 | B2 * | 9/2010 | Sondermann | E04F 19/063 52/287.1 |
| 8,161,708 | B2 * | 4/2012 | Schacht | E04F 15/02005 52/312 |
| 10,138,639 | B2 * | 11/2018 | Moore | E04F 19/063 |
| 2010/0031596 | A1 | 2/2010 | Muehlebach | |
| 2018/0010346 | A1 | 1/2018 | Moore et al. | |

FOREIGN PATENT DOCUMENTS

| | | | |
|---|---|---|---|
| ES | 2250928 | T3 | 4/2006 |
| WO | 2005042875 | A1 | 5/2005 |

OTHER PUBLICATIONS

International Search Report for Corresponding International Application No. PCT/ES2019/070561 dated Mar. 13, 2020 and English translation; 4 pages.

* cited by examiner

*Primary Examiner* — Patrick J Maestri
(74) *Attorney, Agent, or Firm* — LUCAS & MERCANTI, LLP

(57) ABSTRACT

A joint and covering assembly for panels covering floors and having a covering profile having at least one extension with a hidden face arranged facing the floor and an exposed face arranged visible; a base profile with a resting face to make contact with the floor and a supporting face arranged facing the hidden face; and coupling elements between the profiles, having two coupling portions according to different angles with respect to the resting face, and an attachable element coupled in the portions, the attachable element projecting from the hidden face. The coupled arrangement is established such that the exposed face has a different inclination with respect to the resting face according to the portion.

14 Claims, 5 Drawing Sheets

JOINT FOR FLOOR COVERING PANELS AND COVERING ASSEMBLY COMPRISING SAID JOINT

CROSS REFERENCE TO RELATED APPLICATION

This Application is a 371 of PCT/ES2019/070561, filed on Aug. 9, 2019, which is incorporated herein by reference.

TECHNICAL FIELD

The present invention relates to the industry dedicated to covering floors by means of panels in the form of laminate flooring, parquet or floating floors, and more specifically to the industry dedicated to joints for said panels.

STATE OF THE ART

Currently, panels to be arranged covering floors in the form of laminate flooring, parquet or floating platforms are widely known. The panels can be arranged in any shape, such as square or rectangular. Likewise, said panels can be arranged such that they have a haptic and optical appearance corresponding to wood, concrete, etc.

These panels are made of one or more materials. Regardless of the material, said panels inevitably undergo contractions and expansions due to changes in temperature. These phenomena entail a variation in the dimension of each of the panels, as well as of the complete assembly thereof. In this way, there are hollow slots between panels, according to the contractions, as well as lifting of at least some of the panels, according to the expansions.

Accordingly, expansion joints configured to allow for dimensional variations are conventionally arranged. Specifically, these joints are configured to enable movement of the edges of the adjoining panels separated by said joints, the expansion joints being additionally on the panels such that the edges are hidden from view. These expansion joints also prevent the arrangement of hollow slots between the panels, which is undesirable from both a hygienic and aesthetic point of view.

Likewise, on the one hand, due to the requirements of the panels or the requirements of the floors, such as the surface distribution thereof, elements delimiting the edges of the panels must be arranged. These edges may correspond to a location of inaccessible elements, such as a partition or wall.

In these cases, the described expansion joints, or even other expansion joints adapted to this arrangement, are conventionally arranged, such that they enable movement of the panels with respect to said inaccessible elements.

Additionally, on the other hand, delimiting elements of the edges of the panels must be arranged when said edges correspond to an ending of the panels. This ending corresponds to a sharp downward unevenness to a height of the floor itself.

In these cases, transition joints are conventionally arranged to provide an element that covers the edge of the panels, while doing so progressively. In this way, by placing the transition joints, said edges are prevented from being exposed to the view, in addition to preventing tripping and the like with said edges as a consequence of the corresponding sudden unevenness.

According to what has been described, when assembling or placing the panels, different requirements are raised depending on some of the edges, even in one same assembly.

In addition, on many occasions, the operators that are responsible for placing the panels are unaware of the type of joint or solution to be adopted, which requires the availability of various types of joints, at least at the assembly site.

In this way it is clear that the known solutions entail an added complication, in addition to the assembly of the panels, during the transport, storage and even manufacture of the joints.

In view of the described drawback or limitation presented by the currently existing solutions, a solution is required that allows for variation in the size of the panels, while providing simplicity during placement.

OBJECT OF THE INVENTION

In order to meet this objective and solve the technical problems discussed so far, in addition to providing additional advantages that can be derived later, the present invention provides a joint for floor covering panels, the joint comprising a covering profile that has at least one extension with a hidden face to be arranged facing the floor and an exposed face, opposite to the hidden face and to be arranged so that it is visible.

This joint additionally comprises a base profile with a resting face to be arranged making contact with the floor and a supporting face to be arranged facing the hidden face; and coupling elements to establish a coupled arrangement between the covering profile and the base profile.

The coupling elements comprise two coupling portions on the base profile, each of the two coupling portions being defined according to a different angle with respect to the resting face; and an attachable element for being coupled in any one of the two coupling portions, the attachable element projecting from the hidden face.

Accordingly, the coupled arrangement can be established such that the exposed face has a different inclination with respect to the resting face according to each of the two coupled portions.

Preferably, the at least one extension is curved such that the hidden face has a concave shape and the exposed face has a convex shape. Additionally or alternatively, the at least one extension is preferably elastically deformable.

Preferably, the coupling elements are configured to establish the aforementioned coupled arrangement by snap fitting the attachable element in correspondence with one of the two coupling portions.

Additionally or alternatively, the coupling elements preferably comprise contact surfaces configured to establish a retention between the base profile and the covering profile according to the coupled arrangement. The contact surfaces are preferably defined by irregularities, the irregularities being complementary to each other according to the coupled arrangement.

According to a first preferred exemplary embodiment, the attachable element is configured as a female element and each of the two coupling portions is determined by a male element, such that the coupled arrangement is established by inserting any one of the two coupling portions into the attachable element.

Preferably, the attachable element comprises at least one flange and the two coupling portions comprise two ribs, the at least one flange being arranged to receive any one of the two ribs between each other.

According to a second preferred exemplary embodiment, the attachable element is configured as a male element and each of the two coupling portions is determined by a female element, such that the coupled arrangement is established by inserting the attachable element into any one of the two coupling portions.

Preferably, the attachable element comprises a protrusion and the two coupling portions comprise projections, the protrusion being arranged for insertion between the projections. Accordingly, there are preferably three projections, such that one of the projections simultaneously forms part of the two coupling portions.

In order to meet this objective and solve the technical problems discussed so far, in addition to providing additional advantages that can be derived later, the present invention provides a covering assembly for covering floors, which comprises the present joint and at least one of the aforementioned panels.

Optionally, said cover assembly additionally comprises a cladding configured to be arranged between the at least one panel and the floor.

Preferably, the cladding has a thickness that is substantially the same as a minimum separation measurement between a resting face and a supporting face of a base profile comprised in the joint.

DETAILED DESCRIPTION OF THE INVENTION

Figure 1A:
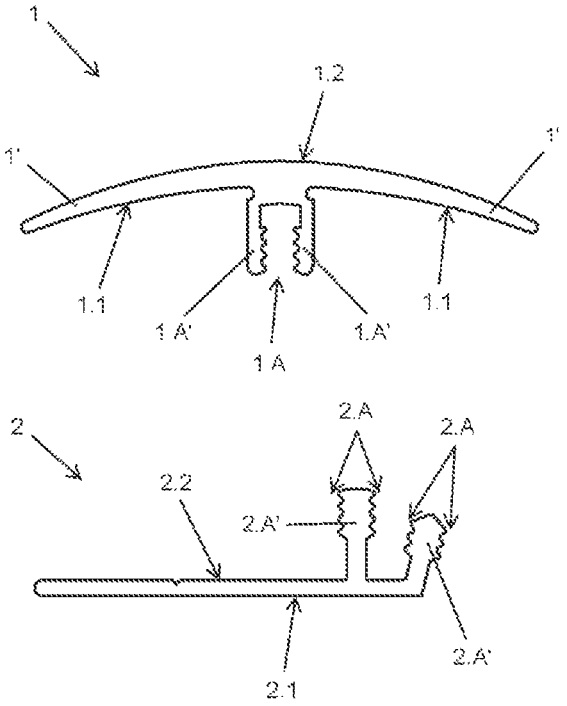
FIGS. 1A and 1B show schematic cross-sectional views of a joint object of the invention, comprising a base profile and a covering profile, according to a first and second exemplary embodiment.

The present invention relates to a joint comprising a covering profile (1) and a base profile (2), this joint being for making contact with panels (3) for covering floors (4). Accordingly, the panels (3) can correspond to laminate flooring, parquet or floating floors.

The covering profile (1) has an elongated configuration. Likewise, said profile (1) has at least one extension (1'), and preferably two, with a hidden face (1.1) to be arranged facing the floor (4) and an exposed face (1.2), opposite to the hidden face (1.1) and to be arranged so that it is visible. The extensions (1') extend longitudinally along the covering profile (1).

Each of the extensions (1') is elastically deformable. In this way, the extensions (1') are deformable or moveable to adapt to different thicknesses of the panels (3) providing contact therewith, either due to the thickness of each of the panels (3) or due to a change in the thickness of the panels (3) because of the expansion thereof. Likewise, since there are two extensions (1'), these extensions (1') are joined or formed from an intermediate zone.

Accordingly, the extensions (1') are arranged to determine the contact with the panels (3) or the corresponding floor (4) by means of an end point thereof, in addition to contacting according to the hidden face (1.1).

In order to facilitate the deformation or mobility of the extensions (1'), the hidden face (1.A) has a concave shape. Likewise, the hidden face (1.A) has preferably a continuous surface, i.e., devoid of surface irregularities, although it can be arranged separated into two portions when the covering profile (1) has two of the described extensions (1').

For the same purpose, in addition to preventing possible blows, for example in the form of tripping, and preventing an accumulation of unwanted things or particles, for example dust, the exposed face (1.B) has a convex shape. According to this aspect, the exposed face (1.B) has a preferably continuous surface, i.e., without surface irregularities.

The base profile (2) has an elongated configuration. Likewise, said profile (2) has a resting face (2.1) to be arranged making contact with the floor (4), or at least facing the same, and a supporting face (2.2) to be arranged facing the hidden face (1.1) of the covering profile (1).

Accordingly, the resting face (2.1) and the supporting face (2.2) are configured such that they form part of a portion in the shape of a laminar body, preferably being parallel to each other. Likewise, these faces (2.1, 2.2) extend laterally and longitudinally such that the corresponding panels (3) are arranged on the supporting face (2.2).

In order to provide a flat arrangement of an exposed surface of the panels (3) covering the floor (4), said laminar body or a minimum separation distance between the resting face (2.1) and the supporting face (2.2) is selected according to a thickness of a cladding (5).

Preferably, this cladding (5) has acoustic insulation and/or soundproofing properties. Likewise, said cladding (5) is configured to be arranged between the panels (3) and the floor (4). Preferably, the cladding (5) is configured to provide cushioning when stepped on by users, both directly and through the corresponding panels (3).

In this way, the present invention also relates to a covering assembly for covering the corresponding floor (4), said assembly comprising the covering profile (1), the base profile (2) and at least one of the panels (3), and preferably a plurality thereof (3).

Preferably, the covering assembly additionally comprises the cladding (5). According to this last aspect, the thickness of the aforementioned cladding (5) and the minimum separation distance between the resting face (2.1) and the supporting face (2.2) are preferably at least substantially the same, and more preferably the same.

The joint comprises coupling elements to establish a coupled arrangement between the covering profile (1) and the base profile (2). The coupling elements are configured such that the coupled arrangement between the covering profile (1) and the base profile (2) can be established according to two positions different from each other, so that the exposed face (1.2) can be arranged according to different positions and has a different inclination with respect to the resting face (2.1) according to each of the two positions.

The coupling elements are configured to establish the coupled arrangement by snap fitting. Likewise, said coupling elements comprise contact surfaces configured to establish a retention between the base profile (2) and the covering profile (1) according to the coupled arrangement.

Figure 1B:
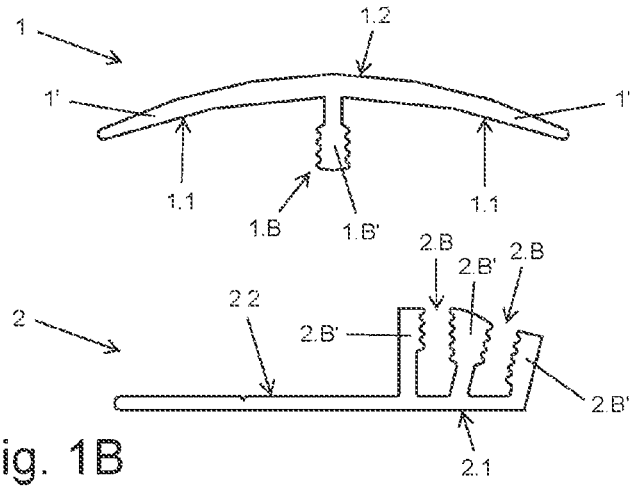

Accordingly, the contact surfaces are preferably defined with irregularities, the irregularities being complementary to each other according to the coupled arrangement. Thus, the contact surfaces have teeth and grooves. These irregularities can be selected such that the teeth are more or less pointed, as can be seen in FIGS. 1B and 1D, respectively.

The coupling elements comprise an attachable element (1.A, 1.B) in the covering profile (1) and two coupling portions (2.A; 2.B) in the base profile (2). Each of the two coupling portions (2.A; 2.B) is defined according to a different angle, this angle being definable as a function of a lateral or transverse inclination according to the elongated configuration of the base profile (2) and with respect to a perpendicularity of the resting face (2.1). See the cross sections shown, for example, in FIGS. 1A, 1B, 1C and 1D of said base profile (2).

The attachable element (1.A, 1.B), for its part, is arranged to be coupled in any one of the two coupling portions (2.A; 2.B), this element (1.A, 1.B) projecting from the hidden face (1.1).

Figure 1C:
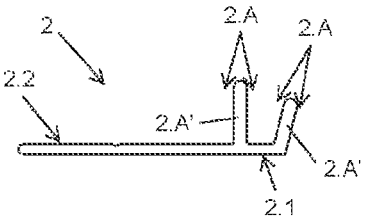
FIGS. 1C and 1D show schematic cross-sectional views of the base profile comprised in the joint, according to a third and fourth exemplary embodiment.
Figure 1D:
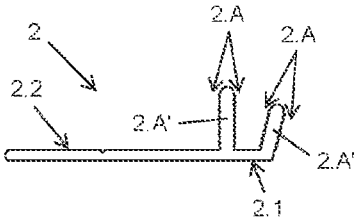
Figure 2A:
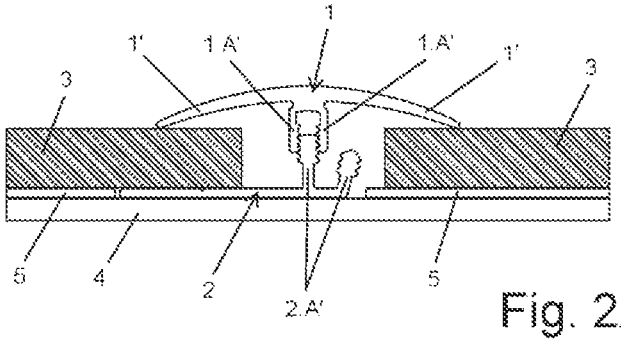
FIGS. 2A, 3A and 4A show schematic cross-sectional views of the joint, according to the first exemplary embodiment.
Figure 2B:
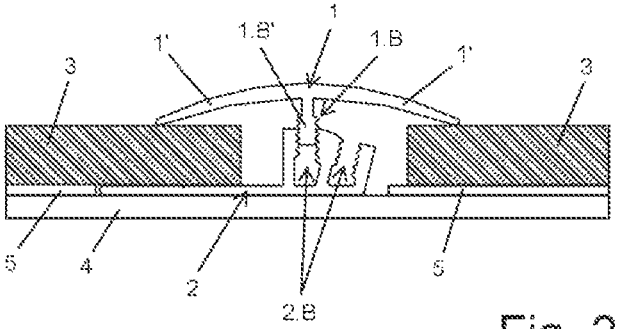
FIGS. 2B, 3B and 4B show schematic cross-sectional views of the joint, according to the second exemplary embodiment.
Figure 3A:
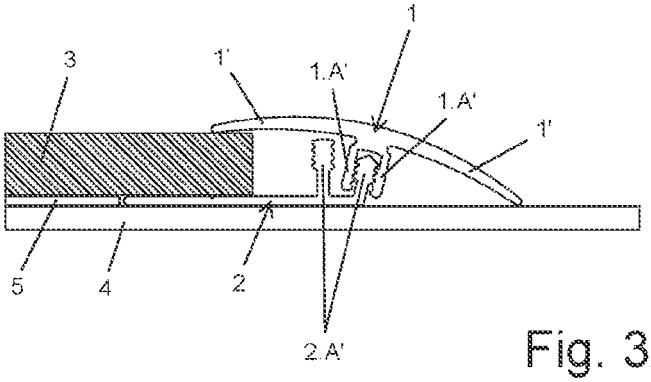
Figure 3B:
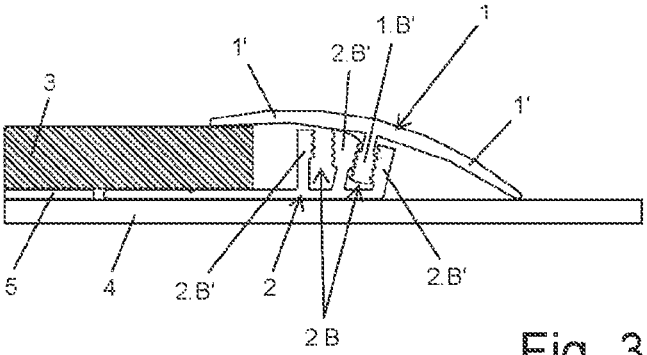
Figure 4A:
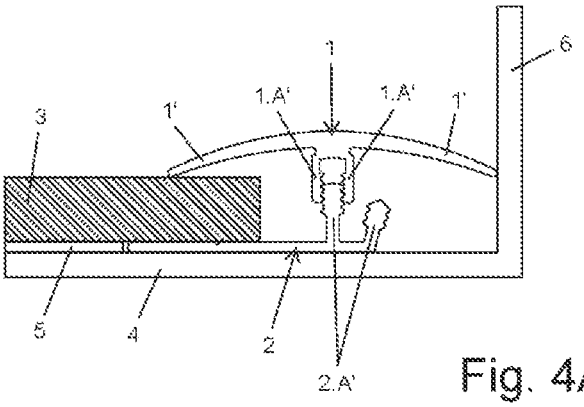
Figure 4B:
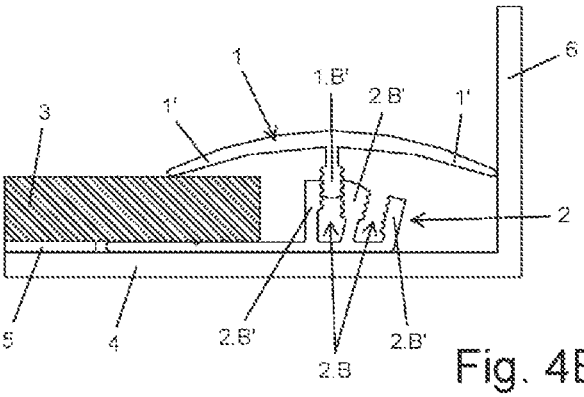

In FIG. 1C, the two coupling portions (2.A; 2.B) can be seen, the corresponding contact surfaces being devoid of the previously described irregularities. In this case, the contact surfaces establish retention by friction according to the snap fitting of the coupled arrangement.

Preferably, the coupling portions (2.A; 2.B) and the attachable element (1.A, 1.B) are arranged according to a continuous distribution along the base profile (2) and the covering profile (1), respectively. Alternatively, the coupling portions (2.A; 2.B) and/or the attachable element (1.A, 1.B) are arranged according to a punctual distribution along the corresponding profile (2, 1).

Accordingly, the coupling elements are preferably configured such that, by means of pressing, the attachable element (1.A, 1.B) is arranged retained in correspondence with one of the two coupling portions (2.A; 2.B).

According to a first preferred exemplary embodiment, the attachable element (1.A) is configured as a female element and each of the two coupling portions (2.A) is determined by a male element. Accordingly, the coupled arrangement is established by inserting any one of the two coupling portions (2.A) into the attachable member (1.A). See FIGS. 1A, 2A, 3A and 4A.

The attachable element (1.A) comprises at least one flange (1.A') and each of the two coupling portions (2.A) comprises a rib (2.A'), the at least one flange (1.A') being arranged to receive any one of the two ribs (2.A') between each other.

Moreover, when the coupling portions (2.A) and the attachable element (1.A) are arranged according to the punctual distribution, or when only the attachable element (1.A) is arranged according to the punctual distribution, there are preferably two flanges (1.A'), these flanges being arranged such that together they laterally surround the corresponding rib (2.A').

Alternatively, and when the coupling portions (2.A) and the attachable element (1.A) are arranged according to the punctual distribution, there is one flange (1.A'), this flange being arranged such that it laterally surrounds the corresponding rib (2.A') along the perimeter.

Moreover, when the coupling portions (2.A) and the attachable element (1.A) are arranged according to the continuous distribution along the base profile (2) and the covering profile (1), respectively, there are preferably two flanges (1.A'), these flanges being arranged such that together they laterally surround the corresponding rib (2.A'). This enables both the covering profile (1) and the base profile (2) to be obtained by extrusion.

According to a second preferred exemplary embodiment, the attachable element (1.B) is configured as a male element and each of the two coupling portions (2.B) is determined by a female element. Accordingly, the coupled arrangement is established by inserting the attachable element (1.B) into any one of the two coupling portions (2.B). See FIGS. 1B, 2B, 3B and 4B.

The attachable element (1.B) comprises a protrusion (1.B') and the two coupling portions (2.B) comprise projections (2.B'), the protrusion (1.B') being arranged for insertion between the projections (2.B'). More specifically, there are three projections (2.B'), such that one of the projections (2.B') simultaneously forms part of the two coupling portions (2.A). Likewise, the protrusion (1.B') is arranged for insertion between two of the three projections (2.B').

On the one hand, the coupling portions (2.B) can be arranged according to the punctual distribution. On the other hand, the protrusion (1.B') can be arranged according to the punctual distribution. Accordingly, both the coupling portions (2.B) and the protrusion (1.B') being arranged according to the punctual distribution, the attachable element (1.B) and the two coupling portions (2.B) are arranged such that they are the same and establish the coupled arrangement with each other.

In accordance with what is described for this joint, in addition to the corresponding panel (3) assembly and optionally the cladding (5), the covering profile (1) and the base profile (2) can be arranged coupled to each other, for example, longitudinally between two of the panels (3), each of these panels being contacted by one of the extensions (1') through the hidden face (1.1). In this way, the joint can be arranged as an expansion joint between said panels (3), while covering a variable distance between the panels as a result of the expansions. See FIGS. 2A and 2B.

Likewise, the covering profile (1) and the base profile (2) can be arranged coupled to each other, for example, as an ending on the floor (4) for arranging the panels (3). In this way, the joint can be arranged as a transition joint between the corresponding panels (3) and the floor (4), in addition to performing the function of an expansion joint for said panels (3), such that a change in level between the panels (3) and the floor (4) is provided in a less abrupt and continuous manner. See FIGS. 3A and 3B.

Likewise, the covering profile (1) and the base profile (2) can be arranged coupled to each other, for example, as a finish for one or more of the panels (3) in correspondence or in proximity to an obstacle or inaccessible element such as a wall (6). In this way, the joint can be arranged as an expansion joint between said panels (3) and the wall, while covering a variable separation between the panels (3) and said wall (6) as a result of the expansions. See FIGS. 4A and 4B.

The invention claimed is:

1. A joint for panels for covering floors, the joint comprising:

a covering profile that has at least one extension with a hidden face arranged facing the floor and an exposed face, opposite to the hidden face arranged so that it is visible;

a base profile with a resting face arranged making contact with the floor and a supporting face arranged facing the hidden face;

coupling elements to establish a coupled arrangement between the covering profile and the base profile, comprising:

two coupling portions on the base profile, each of the two coupling portions being defined according to a different angle with respect to the resting face;

an attachable element to be coupled in any one of the two coupling portions, the attachable element being projected from the hidden face;

wherein the coupled arrangement is established such that the exposed face has a different inclination with respect to the resting face according to each of the two coupling portions.

2. The joint according to claim 1, wherein at least one extension is curved so that the hidden face has a concave shape and the exposed face has a convex shape.

3. The joint according to claim 1, wherein at least one extension is elastically deformable.

4. The joint according to claim 1, wherein the coupling elements are configured to establish the coupled arrangement by snap fitting the attachable element in correspondence with one of the two coupling portions.

5. The joint according to claim 1, wherein the coupling elements comprise contact surfaces configured to establish a retention between the base profile and the covering profile according to the coupled arrangement.

6. The joint according to claim 5, wherein the contact surfaces are defined by irregularities, the irregularities being complementary to each other according to the coupled arrangement.

7. The joint according to claim 1, wherein the attachable element is configured as a female element and the two coupling portions are configured as male elements, so that the coupled arrangement is established by inserting any one of the two coupling portions into the attachable element.

8. The joint according to claim 7, wherein the attachable element comprises at least one flange and the two coupling portions comprise two ribs, the at least one flange being arranged to receive any one of the two ribs between each other.

9. The joint according to claim 1, wherein the attachable element is configured as a male element and the two coupling portions are configured as female elements, such that the coupled arrangement is established by inserting the attachable element into any one of the two coupling portions.

10. The joint according to claim 9, wherein the attachable element comprises a protrusion and the two coupling portions comprise projections, the protrusion being arranged for insertion between the projections.

11. The joint according to claim 10, wherein there are three projections, such that one of the projections simultaneously forms part of the two coupling portions.

12. A covering assembly for covering floors, comprising a joint according to claim 1 and at least one panel.

13. The covering assembly according to claim 12, additionally comprising a cladding configured to be arranged between the at least one panel and the floor.

14. The covering assembly according to claim 13, wherein the cladding has a thickness that is substantially the same as a minimum separation measurement between a resting face and a supporting face of a base profile comprised in the joint.

* * * * *